US005944267A

United States Patent [19]

Haack et al.

[11] Patent Number: 5,944,267

[45] Date of Patent: Aug. 31, 1999

[54] SEPARATOR CUTTER ASSEMBLY FOR MEAT GRINDERS

[75] Inventors: Eberhard Haack, Halle; Richard Meyenschein, Schriesheim, both of Germany

[73] Assignee: Eberhard Haack, Halle, Germany

[21] Appl. No.: 09/128,196

[22] Filed: Aug. 3, 1998

[51] Int. Cl.[6] ..... B02C 18/30

[52] U.S. Cl. ..... 241/82.1; 241/82.2; 241/82.4; 241/82.5

[58] Field of Search ..... 241/82.1, 82.2, 241/82.3, 82.4, 82.5, 82.6, 82.7

[56] References Cited

U.S. PATENT DOCUMENTS

| | | | |
|---|---|---|---|
| 2,476,695 | 7/1949 | Cadella | 241/82.2 |
| 4,153,208 | 5/1979 | Vomhof et al. | 241/82.4 |
| 4,240,591 | 12/1980 | Schnell | 241/82.4 |
| 4,358,061 | 11/1982 | Richter | 241/82.4 |
| 4,844,372 | 7/1989 | Weiler | 241/82.4 |
| 4,928,892 | 5/1990 | Huebner et al. | 241/82.5 |
| 5,791,570 | 8/1998 | Quadrana | 241/82.5 |

FOREIGN PATENT DOCUMENTS

| | | |
|---|---|---|
| 35 22 202 | 1/1987 | Germany . |
| 3820316 | 12/1989 | Germany . |

*Primary Examiner*—John M. Husar
*Attorney, Agent, or Firm*—Karl Hormann

[57] ABSTRACT

An apparatus for removing gristle and the like from meat during a chopping operation in a feed screw apparatus having at least one axially perforated disc with a rotary bearing for receiving the hub of a rotary knife. A channel extends radially through the disc from the rotary bearing to the outside of the apparatus for discharging the gristle fed into it by the rotary movement of the knife arm extending from a hub journalled in the rotary bearing into engagement with a planar surface of the disc.

15 Claims, 6 Drawing Sheets

SEPARATOR CUTTER ASSEMBLY FOR MEAT GRINDERS

BACKGROUND OF THE INVENTION

Field of the Invention

The invention, in general, relates to a cutter assembly for chopping meat and, more particularly, to a cutter assembly for separating gristle, cartilage, sinews and bone fragments from meat to be chopped.

Known separator apparatus of the general kind are usually designed to separate bone chips or particles, cartilage, sinews and other collagenous fibers directly from the production flow of the meat or flesh. This may be done in an axial as well as in a radial or a tangential direction.

For instance, German laid-open patent specification DE-OS 3,522,202 discloses a meat grinder with a separator of this kind. The disclosed meat grinder is provided with a cutter assembly having at least one rotatably driven knife and at least one stationary perforated disc, as well as a feed screw for the meat and a separator for separating undesired components through a central bore in the perforated disc. The separator is provided with a bearing bush inserted into the center of the perforated disc. The bearing bush has a radial flange for supporting the separator. It also has discharge slots in the radial flange as well as an adjustable bush seated in the bearing bush. The cutter assembly is provided with a hub which together with the adjustable bush forms an adjustable discharge slot. The adjustable bush consists of an inner portion mounted for axial movement and a threadedly adjustable outer portion. A compassion spring is seated between the two portions. The compression spring is said to serve the purpose of the separator adjusting itself automatically to any given material to be separated. In this context it is assumed that a given charge of meat to be processed contains different quantities to be sorted out.

An improved version of a separator apparatus of the general kind is disclose by DE-OS 3,820,316. In addition to a feed screw for the meat and a cutter assembly of at least one rotatably driven knife and a stationary perforated disc the disclosed meat grinder is provided with a separator for removing undesired components through a central bore in the perforated disc. For adjusting a discharge slot in the central bore of the perforated disc the separator is provided with an axially movable inner sleeve and a part which is threadedly adjustable.

Reference may also be had to German laid-open specification which discloses a separator for use in meat grinders for removing undesired components. This separator also has a central bore in the perforated disc for ejecting the unwanted components. The disclosure relates to means for adjusting the discharge slot, i.e the annular slot for ejecting the components to be removed, for the exterior and during operation. This is accomplished by a separating tube extending longitudinally of the entire separator and provided with an adjustment device. The tube is connected to a terminal or final perforated disc by a lock nut and an adjustment bush.

The known meat grinders equipped with separators of the kind referred to are provided with what for the sake of simplicity may be called single screws. Hence, the working pressure during a grinding operation of fresh meat is about 5 to about 8 bar, but it is also dependent upon the kind of meat, its quality and the sizes of the pieces. Depending upon the structure and lay-out of the separator as well as the meat grinder, it is not possible to operate at higher work pressure which is detrimental as regards the meat to be ground as well as the degree of separation.

OBJECTS OF THE INVENTION

It is, therefore, an object of the invention to provide a cutter assembly for meat grinding or chopping machines which overcomes the drawbacks of known cutter assemblies.

Another object of the invention is a cutter assembly which may be operated at higher work pressures.

Also, it is an object of the invention to provide a cutter assembly of the kind which ensures separating undesirable components from meat to be chopped to yield an end product of improved quality.

It is also an object of the invention to provide a cutter assembly having at least one and preferably several separation planes.

Furthermore, it is an object of the invention to remove from meat to be chopped undesired components in a direction normal to the feed direction of the meat.

Other object will in part be obvious and will in part appear hereinafter.

BRIEF SUMMARY OF THE INVENTION

In accordance with these and other objects, the invention provides, in a preferred embodiment thereof, a cutter assembly of meat chopping machinery for removing gristle, cartilages, sinews and bone parts, hereinafter collectively referred to as hard impurities, which consists of at least one separation plane and removes such hard impurities in a direction substantially normal to the direction of feed. Furthermore, the invention provides for an apparatus of the general kind which is provided with a reinforced final perforated disc in which a central recess is provided at the side facing the cutter knife, the recess being connected to a radially extending discharge channel terminating in a bore in the housing of the cutter assembly, there being also arranged in the recess a discharge screw associated with and centrally journalling the cutter knife. In its cylindrical wall the recess is preferably provided with flues for facilitating the feeding action.

A cutter assembly for separators in meat chopping machinery is provided which permits being operated in high pressure ranges while at the same time ensuring removal of hard impurities to yield end products of improved quality. This is accomplished, at least in part, by a separator cutter set structured as a pressure system and laid out in such a manner that the enclosed pressure system in formed from the center portion of the perforated separator discs so that the components to be separated are selected for forced feeding from the center of the perforated separation discs in a lateral direction by specially structured and arranged discharge channels.

The separator cutter set may be structured as a single as well as a multiple component set. As a multiple component set it consists of a pre-cutter, a normal knife, a perforated disc, a separator knife and a final perforated disc structured as a perforated separator disc. The perforated separator disc constitutes an important element of the separator cutter set in accordance with the invention. Compared to conventional discs of the kind, it is of a substantially stronger structure, i.e. greater thickness so that it can withstand pressures in the range of 50 bar. It also ensures separation and removal of undesirable components such as gristle, cartilage, sinews and the like. In accordance with the invention, the perforated separator disc is provided with a recess or blind hole with a transverse bore entering into it as a discharge channel. Moreover, flues are provided in the inner wall of the blind hole to improve the feeding action.

The discharge channel is provided in one side of the perforated disc and leads into the blind hole. Relative to other components of the cutter set, the assembly and arrangement of the perforated separator disc is such that the cutting blades of the separator knife positioned in front of the perforated separator disc are in intimate contact with the surface thereof and that the discharge screw extends into the blind hole of the perforated separator disc. The perforated separator disc is clamped against the cutter housing by a sleeve nut.

In accordance with the invention at least one opening having a control valve therein is provided near the cutter assembly housing in alignment with the discharge channel.

The knives are driven by a knife pin extending from the pressure and feed screw or by a so-called knife shaft connected to the pressure and feed screw. In such a structure rotational movement of the screw is transmitted to the cutting elements.

In accordance with another preferred embodiment of the invention the separator cutter set is provided with one or two cutting planes. To this end, a second perforated separator disc is provided which replaces the hitherto commonly used perforated disc and is disposed between the normal cutter knife and a separator knife. Instead of being provided with a blind hole, such a perforated separator disc will have a through bore for receiving the knife hub. It is, however, sized so that only the knife pin and knife hub can penetrate through for driving the separator knife on the other side of the disc. In all other respects it is similar to the final perforated disc. The knife hub closes the central bore of the second perforated separator disc so that no hard components may penetrate to the next cutting plane. If the separator cutter assembly is structured as a so-called Enterprice cutter set it will consist of one knife and one perforated separator disc.

In accordance with yet another advantageous embodiment of the invention the final perforated separator disc is threaded in its center for receiving a filling funnel. By such a structure of the perforated separator disc a sausage filling arrangement may be mounted directly on the cutter assembly housing for filling sausage casings slipped over the funnel.

Such a filling funnel ensures further and uninterrupted feeding of chopped meat in its original direction. Advantageously, the funnel is inclined substantially similar to the inclination of the sausage dough. The filling funnel may be structured such that its outer diameter corresponds to the non-perforated surface of the final perforated disc.

In accordance with a further embodiment of the invention a discharge valve is provided in the discharge opening of the cutter assembly housing which is controlled to be opened in response to the pressure prevailing within the separator cutter assembly. The pressure dependent control of the valve opening is accomplished by measuring the pressure within the separator cutter assembly. Pressure sensors feed their measurements to a computer for comparison with stored values and for controlling a motor controlling the valve opening or adjustment thereof. Thus, at pressure deviations the discharge opening of the discharge valve can always be controlled in such a manner that the removal of the hard impurities is precise. Also, the valve also ensures that the feeding process of the chopped meat is not detrimentally affected or interrupted. Of course, manual control of the discharge valve would also be possible but hardly as efficient as its pressure-responsive control. Manual control may be facilitated by optical or acoustic indications of given pressure levels.

Preferably, horizontally adjustable chutes may be provided for feeding the separated components to appropriate containers.

DESCRIPTION OF THE SEVERAL DRAWINGS

The novel features which are considered to be characteristic of the invention are set forth with particularity in the appended claims. The invention itself, however, in respect of its structure, construction and lay-out, as well as manufacturing techniques, together with other objects and advantages thereof, will best be understood from the following description of preferred embodiment when read with reference to the appended drawings, in which:

DETAILED DESCRIPTION OF PREFERRED EMBODIMENTS

Figure 1:
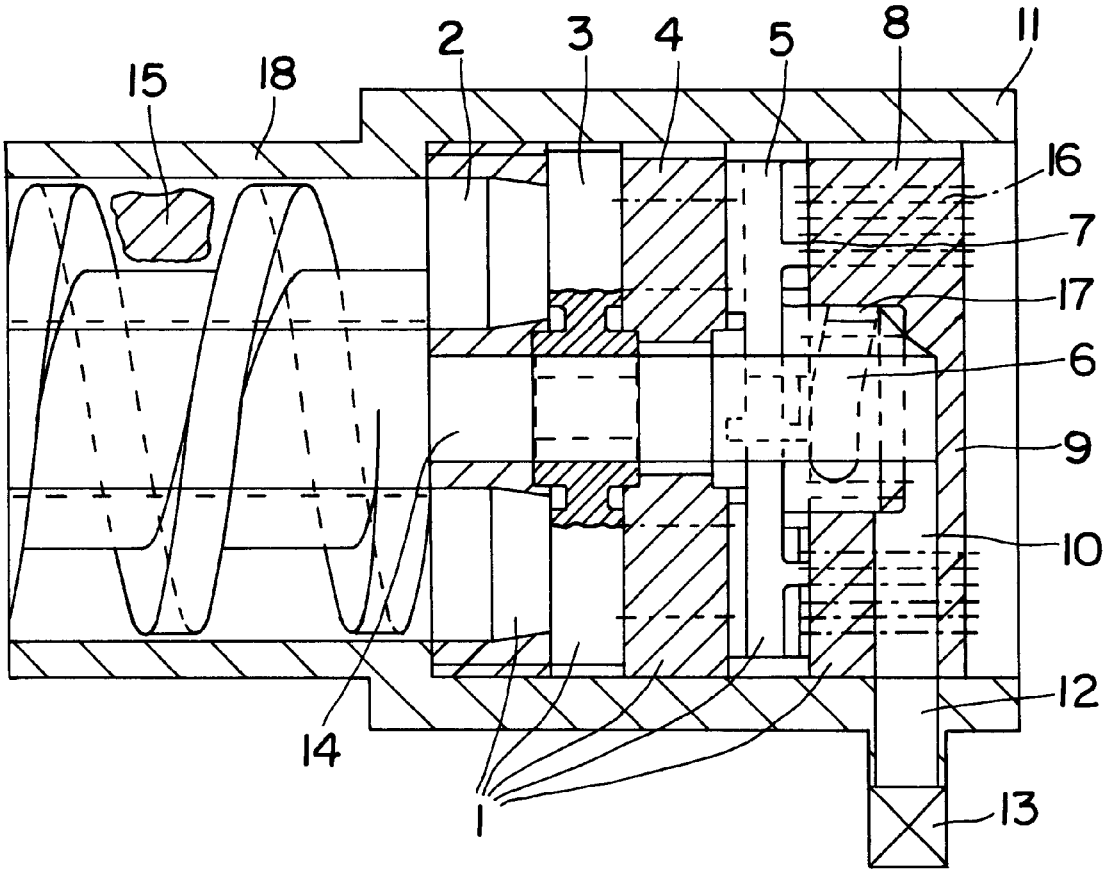
FIG. 1 is an longitudinal section of arrangement of a five piece cutter set with a housing and a feeder housing.

An overall impression of the structure and layout of the novel separator cutter assembly may be gained from FIG. 1.

The separator cutter assembly or set is made up of individual components positioned in a housing 11, one behind the other, such as precutters 2, knives 3, perforated disc 4, separator knife 5 and perforated separator disc 8. The components are coaxially arranged on a knife pin 14 of a pressure and feed screw 1. They are positioned within the housing 11 and maintained therein in axial alignment by a lock nut (not shown). Those components which are not driven such as the precutters 2, the perforated disc 4 and the perforated separator disc 8 are secured against rotation within the housing 11.

A pressure and feed screw 1 is mounted within a pressure and feed housing 18. The screw 1 moves raw material 15 through the housing 18 and drives the knife 3 and the separator knife 5 by way of a pin 14.

The knife pin 14 may be directly affixed to the pressure and feed screw 1 or a specially configured knife shaft positively or frictionally connected to the pressure and feed screw 1 may be used instead. It is, however, necessary to configure the knife shaft such that the knife 3 and the separator knife 5 can be accommodate on, and be driven by, it.

In accordance with the embodiment depicted in FIG. 1 the precutter 2, the knife 3 and the perforated disc 4 of the separator cutter assembly are conventional and commercially available components. To the right of these components there is provided the separator knife 5 which may have serrated or specially configured cutting edges slidably engaging the front surface of the perforated separator disc 8 for chopping the raw material and for moving the hard impurities from the surface of the disc 8 to the center of the separator cutter set. In its hub section the knife 5 is conventionally structured such that it extends into the axial bores of the perforated disc 4 and of the perforated separator disc 8, and, in the direction of the separator disc 8 it is structured as a discharge or disposal screw 6 for moving the hard impurities to the discharge channel 10 through which they are disposed from the system in a direction normal to the feed direction of the meat to be chopped. To this end the discharge channel 10 terminates in an opening 12 of the housing 11. In the embodiment shown, a control vale 13 is provided in the opening 12 for regulating the quantity of discharged material.

Unlike conventional final perforated discs, the perforated separator disc 8 used herein is of a substantially larger thickness, i.e, its thickness measures from between about 25 mm to about 50 mm. Also, the perforated separator disc 8 herein shown is provided with a center blind hole 9 used for receiving the hub of the discharge screw 6 of the separator knife 5 and provided in its cylindrical surface with flues 17 ending at the bottom of the blind hole 9.

The perforated separator disc 8 is seen to be provided with a discharge channel 10. Preferably, the channel 10 is a bore extending radially from the circumference of the disc 8 into the bottom of the blind hole forming a trough therein.

As is otherwise conventional, the separator perforated disc 8 is penetrated by a plurality of through-bores 16 through which chopped meat may be discharged from the housing 11. These through-bores are distributed substantially evenly over the surface of the disc 8, except that there are no bores entering into the trough. This ensures that no undesirable meat components are mixed in with the desirable meat and that they are discharged through the channel 10. In order further to facilitate the discharging of the undesirable meat components the terminal section of the trough or channel 10 in the bottom of the blind hole is beveled.

Figure 2:
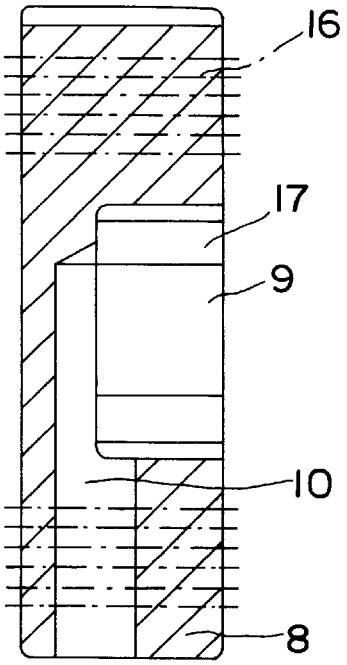
FIG. 2 is a view in axial section of a separator disc.

FIG. 2 depicts a perforated disc 8 in accordance with the invention for use in a separator. As shown, the discharge channel 10 extends between the blind hole 9 and the circumference of the disc 8. The flues 17 may also be seen in t FIG. 2.

Figure 3:
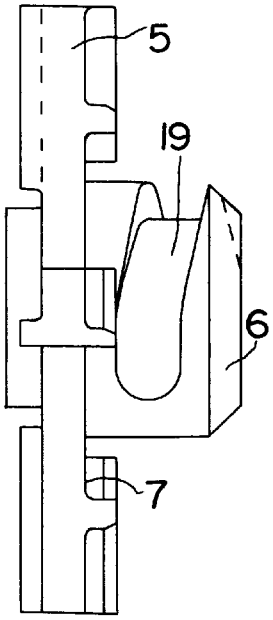
FIG. 3 is a side elevation of a separator knife and discharge screw.
Figure 5:
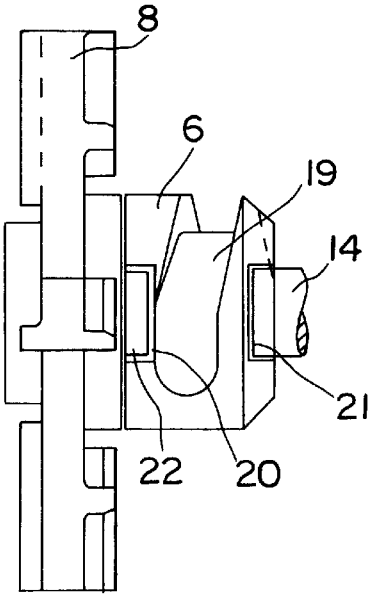
FIG. 5 is a side elevational view of a discharge screw.
Figure 6:
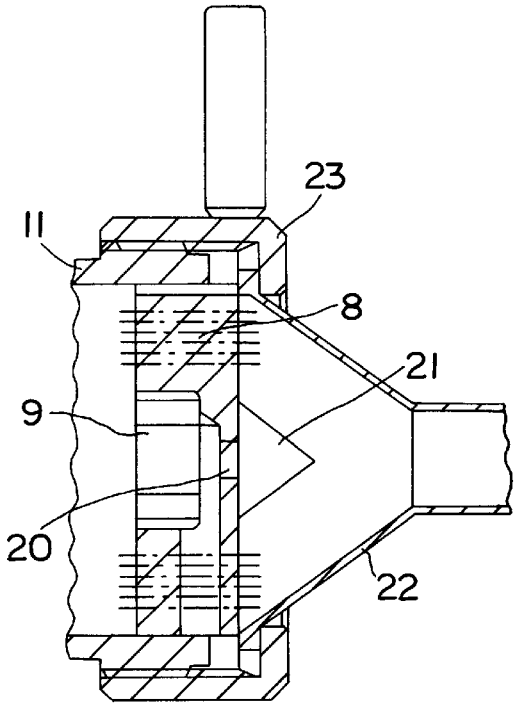
FIG. 6 is a view in longitudinal section of a separator cutter set including a sausage funnel.

FIG. 3 depicts a structure of a separator knife 5 of the kind found to be particularly useful. As may be seen, the hub of the knife 5 is structured as a screw 6 which facilitates the removal of hard impurities from the chopped meat through the discharge channel 10. In the embodiment shown, the hub is provided in its circumference with a flue or groove 19 of predetermined inclination, depth and width. The groove 19 extends in the feed direction towards the bottom of the blind hole 9 and enters into the trough formed therein by the channel 10. While as here shown the hub of the separator knife 5 is an integral part thereof, it will be understood by those skilled in the art, that separate components having a similar groove in their circumference and being keyed for rotation with the knife 5 are possible as well. Such a structure is shown in FIG. 5, in which the discharge screw 6 is provided with recesses 20, 21 at its ends for connecting it to the a knife pin 14 of the pressure and feed screw 1 and to a pin 22 protruding from the bottom of the blind hole 9 of the perforated separator disc 8. The recess 21 is keyed to the shape of the knife pin 14, and the recess 20 is circular so that it may rotate relative to the circular pin 22. Guidance and bearing of the separator knife 5 are thus ensured.

Figure 4:
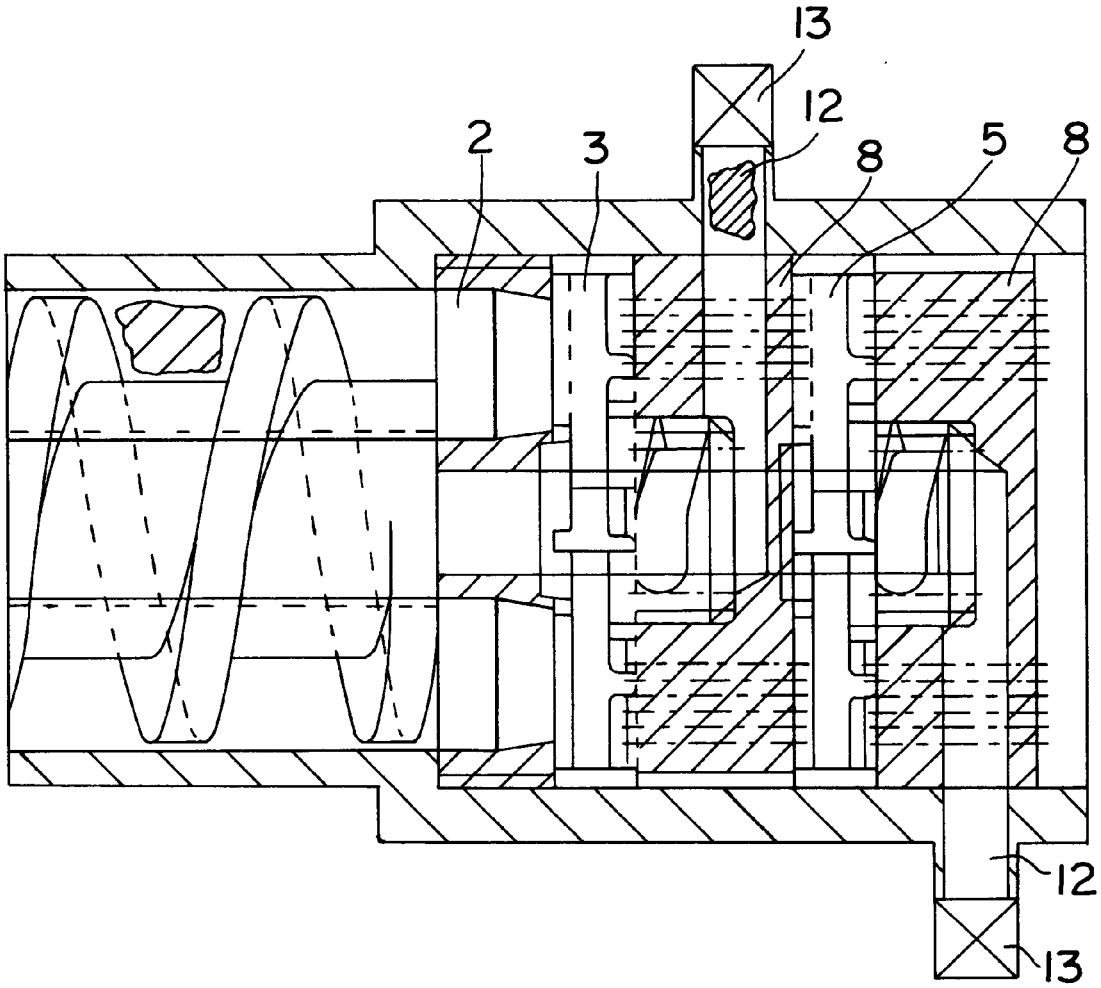
FIG. 4 is a view in longitudinal section of a cutter assembly with two separator planes.

For improving the removal of hard impurities from the chopped meat, the separator cutting assembly in accordance with the invention may be provided with two separation planes. This is made possible by sequentially arranging two perforated separator discs 8 and pertinent separator knives as shown in FIG. 4.

This arrangement consists of five components, i.e., the precutter 2, the knife 3, the first perforated separator disc 8, the separator knife 5, a second perforated separator disc 8. The first perforated disc 8 positioned in the center is similar to the second disc 8 disposed to the right of it, except that it has not blind hole. Instead, it is provided with an axial through-bore corresponding in its configuration to the knife pin 14. As in the embodiment described previously, removal of undesired meat components is accomplished by a discharge screw 6 at each of the separator discs 8. Both screws 6 are removable in the manner previously described.

As regards the function of the apparatus, the knife pin 14 is rotatably driven by the pressure and feed screw 1 and in turn drives the knives 3 and 5. At the same time, the pressure and feed screw moves the raw material 15 forwardly into the first perforated disc where it is chopped by the knife 3 and where undesirable meat components are removed by the discharge screw into a first channel 12 the opening of which is controlled by a valve 13. Thereafter, the raw material is chopped again by the knife 5 at the second perforated disc 8, and any residual hard impurities are removed through the discharge channel 12 associated therewith. The knife 5 has an oblique cutting edge 7 which engages the perforated surface of the disc 8 so that the meat is chopped at the through-bores 16. Any hard impurities such as gristle, sinews, cartilage, other collagenous fibers and bones are not cut at the cutting edges of the bores but they are moved, by the oblique cutting edge and rotary movement of the knife 5, toward the center of the knife hub where they are received by the discharge screw 6. With the assistance of the flue 17 they are then fed into the blind hole 9 from where they are moved into the channel 10 for disposal through the opening 12 thereof. Not only do the flue 17 assist in drawing the hard components into the blind hole 9, they also lend support to them for feeding to its bottom and into the groove of the channel 10. The process is facilitated by the configuration of the groove 19 of the discharge screw 6. Preferably, the groove has an inclination of from about 5 mm to about 30 mm and its depth may be between about 2 mm and about 15 mm.

The special configuration of the groove 19 and the action of the flues 17 in the side wall of the blind hole 9 result in sorting under high pressure; the hard impurities are discharged through the channel and its opening 12 with the valve 13 therein, whereas the viscous and elastic meat is fed out centrally or axially from the housing of the cutter assembly.

In an advantageous embodiment of the invention a sausage funnel or spout 22 may be mounted in front of the output end of the cutter housing 11 by a sleeve nut 23. Such a configuration may be selected whenever the meat chopped by the apparatus is to be fed directly into sausage casings. In that case the sausage casing is slipped onto the funnel or spout 22 (not shown). Preferably, a filling cone 21 is placed in front and in the center of the perforated separator disc 8. To this end the cone 21 may be provided with an axial stud 20 to be threadedly connected to the perforated disc 8. Preferably, the configuration of the filling cone 21 may conform to the configuration of the filling spout 22. This has been found to facilitate the feeding and filling action of the apparatus. The outer diameter of the cone 21 preferably corresponds to the diameter of the non-perforated center portion of the disc 8.

Figure 7:
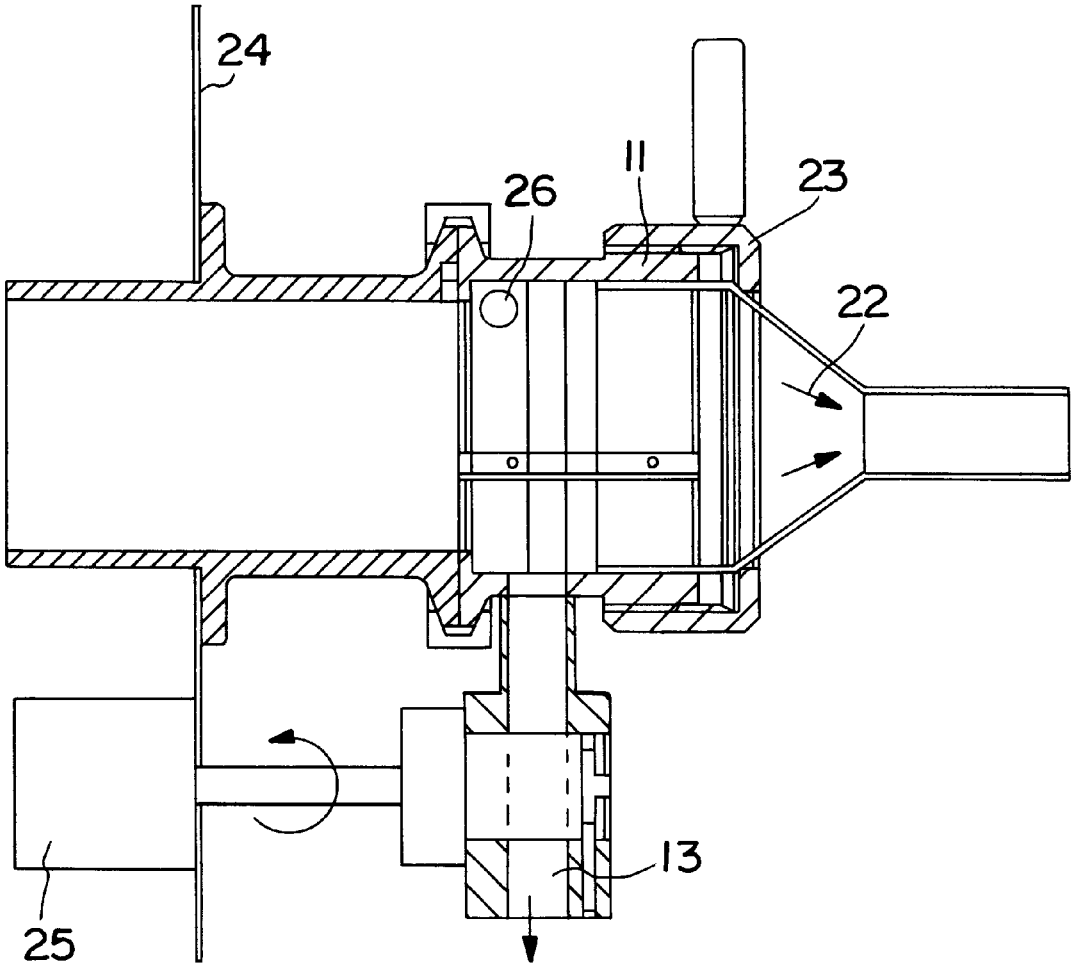
FIG. 7 is a schematic presentation of the automatic adjustment of a control valve.

An automatic pressure controlled discharge of the hard impurities through the channel 12 is accomplished by means connected to the control valve 13 and shown in FIG. 7. An automatic and pressure controlled discharge of the hard impurities is desirable in view of the fact that different kinds of meat require different cutter sets or assemblies. In particular, discs may be used with different through-holes. This would lead to different pressures within the entire housing which affect the flow of the material through the housing as well as the quality of the hard impurities to be discarded.

Thus it is desirable and, indeed, necessary to control the discharge of the hard impurities as a function of the pressure conditions in the separator cutter set to ensure a proper meat chopping and feeding operation and to prevent the controlled discharge of the hard impurities from adversely affecting the those processes.

In the embodiment shown in FIG. 7, this is accomplished by a pressure-responsive control of the opening of the control valve 13. Pressure sensors 26 are provided within the housing 11 of the cutter set and their measurements are fed into a computer (not shown). The sensors 26 are also connected to a motor 25 for driving a control member of the valve 13. The motor 25 is mounted on a portion 24 of the housing and adjusts the output opening of the valve 13 on the basis of information received from the computer. As is well known, the hard undesirable components often prevent a static discharge control because of blockage of the discharge opening of the valve 13, pressure will automatically increase in the separator cutter set output. This increase is detected by the sensors 26 and may be compared against values stored in a look-up table or memory of the computer for driving the motor 25 so as to adjust the discharge opening of the valve. If the pressure is reduced, the size of the discharge opening of the valve 13 is reduced as well. The motor may be a stepper motor and may be switched such that a 30° rotation moves the discharge opening of the valve between closed and open terminal positions to accommodate the pressure conditions within the separator cutter housing. A desired value is set when operation of the machine is initiated and is thereafter maintained by the interaction between the pressure sensors 26, the motor 25, the computer and the control valve 13. Preferably, valve adjustments are suppressed by pressure deviations which are less than 10% of the preset desired value. Other circumstances may, however, require different control patterns. It would be possible, of course, to control the valve opening manually.

Figure 8:
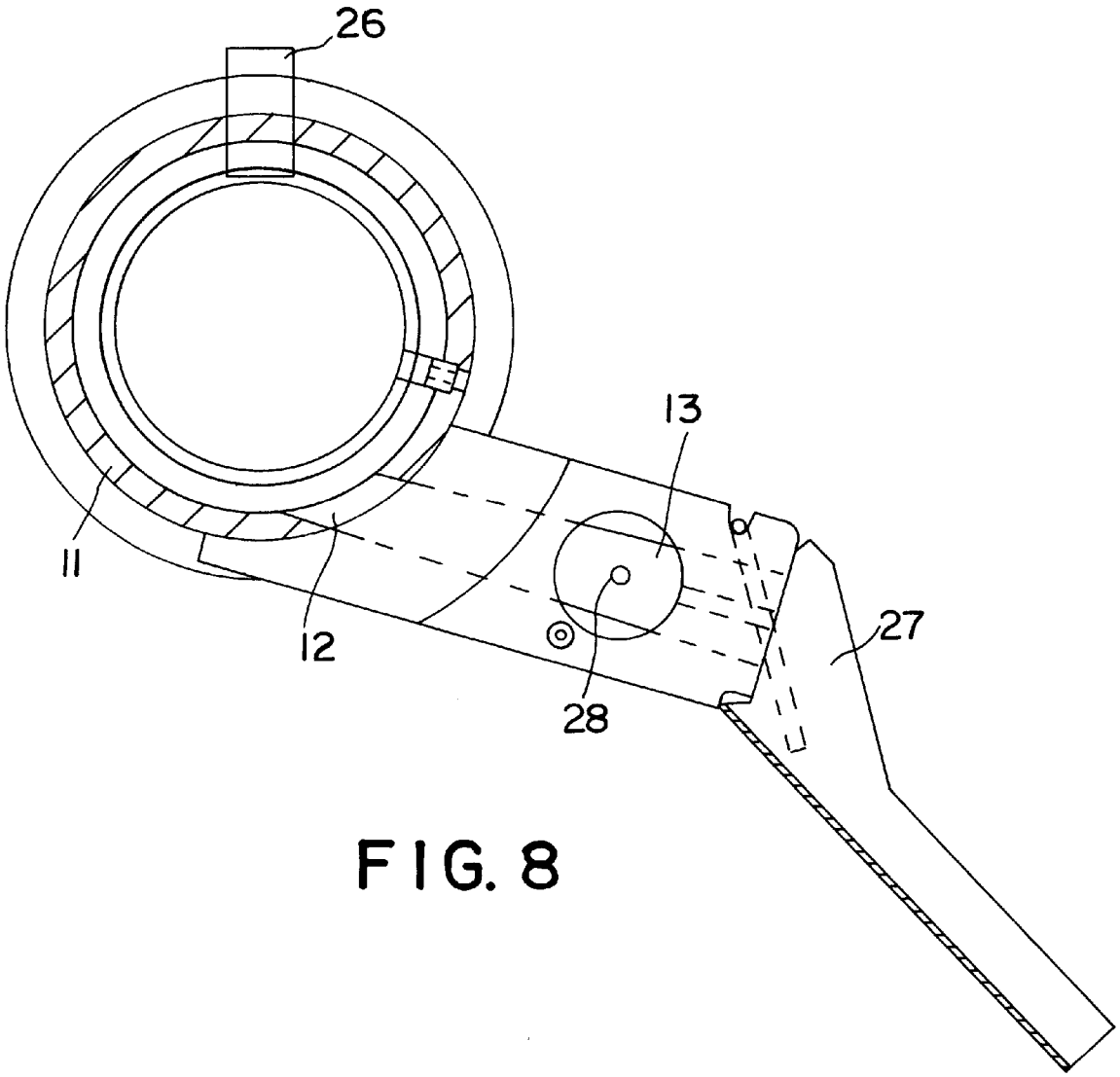
FIG. 8 is a schematic presentation in cross section of a separator cutter set and associated discharge chute.

FIG. 8 depicts the discharge channel 12 and its connection with a chute for removing the discharged hard impurities. The output shaft of the motor 25 is shown at 28.

What is claimed is:

1. An apparatus for removing hard impurities from meat being processed in a meat chopper, comprising:

a chamber comprising means for forming a wall of substantially cylindrical configuration and having at least one radial opening therein;

a feed screw received in the chamber for rotation about a predetermined axis for feeding meat between first and second axially removed positions of the chamber;

a first disc peripherally engaging the cylindrical wall and having a substantially planar surface disposed in a plane substantially normal to the axis adjacent one of the first and second positions and comprising a substantially blind hole having a cylindrical side wall and a bottom wall removed from the surface by a predetermined distance for receiving the hub, at least one first channel radially removed from the blind hole and penetrating through the disc and at least one second channel extending between the blind hole and the at least one radial opening in the cylindrical wall; and a first knife adapted to be rotated by the feed screw and comprising a hub rotatably received in the blind hole and at least one arm extending radially from the hub and forming a cutting edge adapted slidingly to engage the surface.

2. The apparatus of claim 1, wherein the second channel extends into a channel formed in the bottom wall of the blind hole.

3. The apparatus of claim 2, wherein the hub is of cylindrical configuration and is provided in its surface with a helical groove extending between the arm and the groove in the bottom of the blind hole.

4. The apparatus of claim 3, wherein at least one flue is provided in the cylindrical side wall of the blind hole.

5. The apparatus of claim 4, wherein the hub and the arm are of integral construction.

6. The apparatus of claim 4, wherein the hub and the arm are releasably connected.

7. The apparatus of claim 2, wherein the hub of the second knife is of cylindrical configuration and is provided in its surface with a helical groove extending from the arm.

8. The apparatus of claim 7, wherein the fourth channel extends to the helical groove opposite the arm.

9. The apparatus of claim 8, wherein at least one flue is provided in the wall of the through-bore.

10. The apparatus of claim 9, wherein the hub and the arm of the second knife are of integral construction.

11. The apparatus of claim 9, wherein the hub and the arm of the second knife are releasably connected.

12. The apparatus of claim 1, further comprising a second disc peripherally engaging the cylindrical wall and having a substantially planar surface disposed intermediate the first and second positions in a plane substantially parallel to the surface of the first disc and comprising a through-bore having a cylindrical side wall, at least one third channel radially removed from the through-bore and penetrating through the disc and at least one fourth channel extending between the through bore and another radial opening in the cylindrical wall; and a second knife adapted to be rotated by the feed screw and comprising a hub rotatably received in the through bore and at least one arm extending radially from the hub and forming a cutting edge adapted slidingly to engage the surface of the second disc.

13. The apparatus of claim 7, wherein the first knife is driven by axial engagement of its hub with the hub of the second knife.

14. The apparatus of claim 7, wherein the thickness of the first and second discs is from about 25 mm to about 50 mm.

15. The apparatus of claim 7, wherein the first and second discs are each of a strength to withstand an axial pressure of about 50 bar.

* * * * *